US006024221A

United States Patent [19]

Yuyama et al.

[11] Patent Number: 6,024,221

[45] Date of Patent: Feb. 15, 2000

[54] AMPULE STORAGE BAG

[75] Inventors: Shoji Yuyama; Masaru Matsumoto; Hiroshi Nose; Hiroyasu Hamada, all of Toyonaka, Japan

[73] Assignee: Kabushiki Kaisha Yuyama Seisakusho, Osaka, Japan

[21] Appl. No.: 09/045,933

[22] Filed: Mar. 23, 1998

[30] Foreign Application Priority Data

Mar. 25, 1997 [JP] Japan ..... 9-113309
Feb. 19, 1998 [JP] Japan ..... 10-037567

[51] Int. Cl.[7] ..... B65D 1/09

[52] U.S. Cl. ..... 206/528; 206/538; 206/438

[58] Field of Search ..... 206/528, 538, 206/540, 532, 534, 459.5, 523, 769, 813, 438, 806; 383/9, 10

[56] References Cited

U.S. PATENT DOCUMENTS

| | | | |
|---|---|---|---|
| 1,190,492 | 7/1916 | Way, Jr. | 383/10 |
| 1,853,622 | 4/1932 | Kennedy | 206/806 |
| 1,969,428 | 8/1934 | Schwartz | 206/806 |
| 3,026,016 | 3/1962 | Scher | 206/466 |
| 3,235,168 | 2/1966 | Nichols | 383/106 |
| 3,748,098 | 7/1973 | Dutch | 206/532 |
| 3,784,086 | 1/1974 | Forbes, Jr. | 383/106 |
| 3,834,526 | 9/1974 | Zine, Jr. | 206/437 |
| 4,155,454 | 5/1979 | Ryden | 206/532 |
| 4,189,053 | 2/1980 | Stagnitto et al. | 206/570 |
| 4,721,204 | 1/1988 | Shee | 206/528 |
| 4,811,845 | 3/1989 | Baggett | 206/534 |
| 5,617,948 | 4/1997 | Rainey | 206/6.1 |
| 5,758,775 | 6/1998 | Lowe | 206/571 |

*Primary Examiner*—S. Thomas Hughes
*Assistant Examiner*—Trinh T. Nguyen
*Attorney, Agent, or Firm*—Wenderoth, Lind & Ponack, L.L.P.

[57] ABSTRACT

An ampule storage bag can store ampules for one patient and can engage a transfusion bottle for the same one patient. The ampule storage bag includes a nontransparent sheet and a transparent sheet bonded along the edge to the nontransparent sheet so as to define an opening along the edge. The bag is formed with two holes for engaging a neck of a transfusion bottle. The holes are provided symmetrically with respect to a fold line provided near the opening. Cushion members are provided in the bag to arrange ampules in order in the bag and to prevent breakage of the ampules.

5 Claims, 8 Drawing Sheets

AMPULE STORAGE BAG

BACKGROUND OF THE INVENTION

This invention relates to an ampule storage bag which can store ampules designated in a prescription and can be mounted on a transfusion bottle designated in the same prescription.

Some therapeutic drugs are put in ampules (or vials), while others are put in transfusion bottles. In many cases, drugs in ampules are used together with a drug in a transfusion bottle for each patient. Ordinarily, a plurality of ampules are used for each patient. A plurality of ampules prescribed for each patient are packaged in a bag, and collected in a bucket (or a tray) together with a transfusion bottle.

Ampules are packaged in the manner as disclosed in unexamined Japanese patent publication 2-60648. In many cases, drugs in such ampules are used not for direct injection but after being mixed with the drug in the bottle. For example, drugs in ampules are mixed with glucose liquid in a transfusion bottle and supplied by dripping into the body of a patient who is unable to take meals.

In collecting packaged ampules and a transfusion bottle for each patient and mixing drugs in the ampules with the drug in the bottle, pharmacists experience the following difficulties. First, a pharmacist has to check if the packaged ampules and the bottle are for the same patient. If he fails to find out that the ampules and the bottle are not for the same patient but for two different patients, there is no other way to find out this error in later stations.

In the arrangement in which an automatic packaging device is used to automatically package ampules in a bag and put the bag into a bucket together with a transfusion bottle, ampules may be broken. Broken ampules have to be replaced with new ones. Also, ampule bags may be put in the wrong buckets. Such mistakes can lead to serious malpractice cases.

An object of this invention is to provide an ampule storage bag which improves the reliability of inspection and working efficiency and prevents the breakage of ampules, and is easy to handle.

SUMMARY OF THE INVENITON

According to the invention, there is provided an ampule storage bag comprising a nontransparent sheet and a transparent sheet bonded to the nontransparent sheet at edges of three sides so as to define a bag with an opening along one side, the bag being formed with holes or cutouts extending through the nontransparent and transparent sheets near the opening for engaging with a neck of a transfusion bottle.

Ordinarily, a plurality of ampules are put in the bag. A phamacist can easily see and check the ampules in the bag through the transparent sheet.

A pharamacist can also easily check whether or not the ampules in the bag and the bottle to which the bag is attached are for the same patient. If the bottle is the right one, the bag is attached to the bottle by inserting its neck to the bottleneck-engaging holes formed in the bag. The bottleneck-engaging holes are formed in various sizes to cope with bottles of different types.

With a transfusion bottle engaged in the bottleneck-engaging holes, the bag is moved to the drug mixing station. The bottle will never separate from the bag on the way. Even if it should separate from the bag, a pharmacist can easily collate the bottle with the ampules in the bag because he can see the ampule in the bag through the transparent sheet.

Other features and objects of the present invention will become apparent from the following description made with reference to the accompanying drawings, in which:

DETAILED DESCRIPTION OF THE PREFERRED EMBOIMENT

An embodiment of this invention is now described with reference to the drawings.

Figure 1:
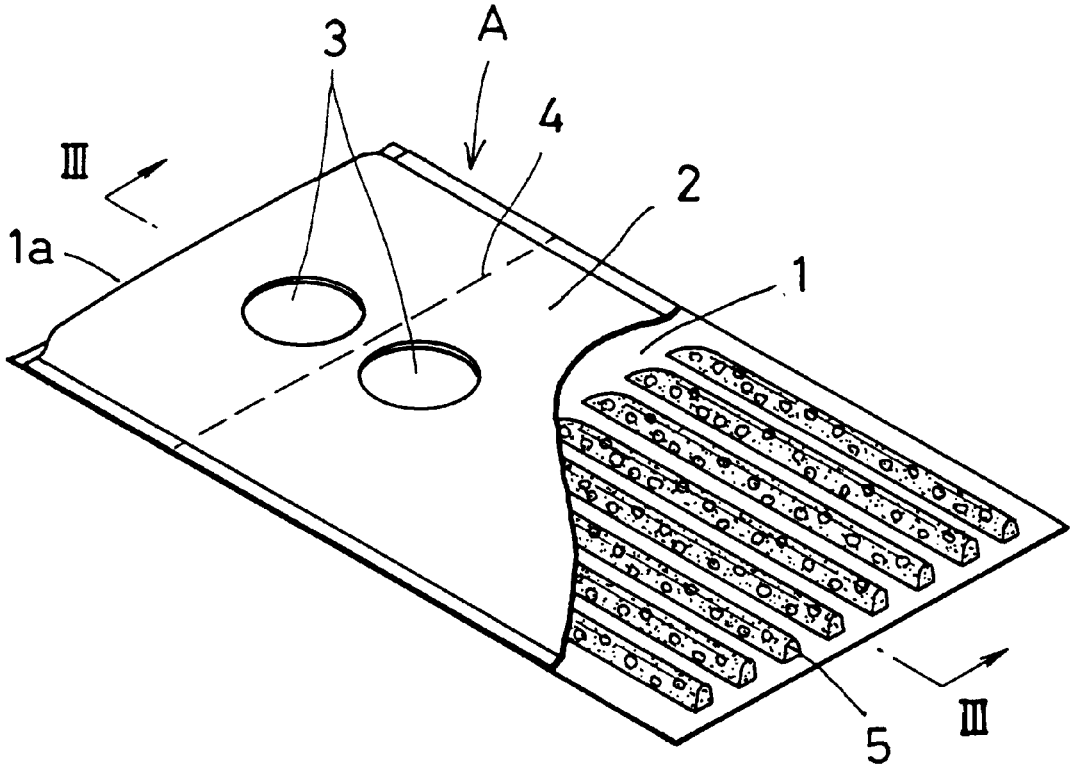
FIG. 1 is a perspective view of an ampule storage bag embodying the invention.

FIG. 1 is a perspective view of an ampule storage bag embodying the invention. The ampule storage bag A is a bag comprising a nontransparent sheet 1 and a transparent sheet 2 superposed on the sheet 1 and bonded together along three sides. The sheets may be adhesively sealed together. Otherwise, they may be formed from a heat-sealable material and heat-sealed together along three sides.

One of the sheets has its unsealed edge slightly protruding from the other sheet to provide a tab. An operator can easily open the bag A by grabbing the tab. Slightly under the opening of the bag A, two holes 3 having a diameter corresponding to the diameter of the neck of a transfusion bottle are formed through the sheets 1, 2 so as to be symmetrical with respect to a fold line 4 (shown by a dash line). The opening of the bag is closed by folding the bag along the line 4. The line 4 may be a printed mark or a cut formed when the sheets 1, 2 are formed or after the holes 3 are formed.

The holes 3 have to be formed at such positions that the bag A will not be broken when the bag is transported while hanged from the neck of a transfusion bottle and that the holes 3 will not unduly reduce the capacity of the bag to accommodate ampules. Cushion members 5 are attached to the inner surface of the nontransparent sheet 1 so as to define longitudinal grooves therebetween. Ampules put in the bag are arranged in order by fitting them in the respective longitudinal grooves. The cushion members 5 prevent the ampules from getting broken by colliding against each other.

Figure 2:
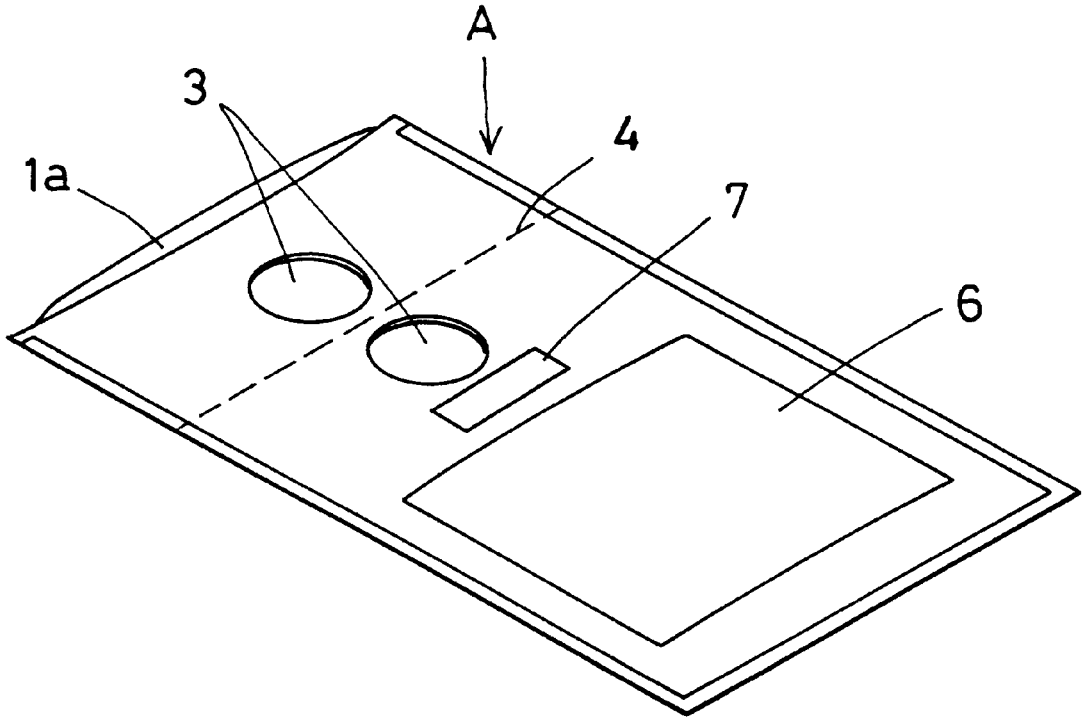
FIG. 2 is a back perspective view of the ampule storage bag of FIG. 1.
Figure 3A:
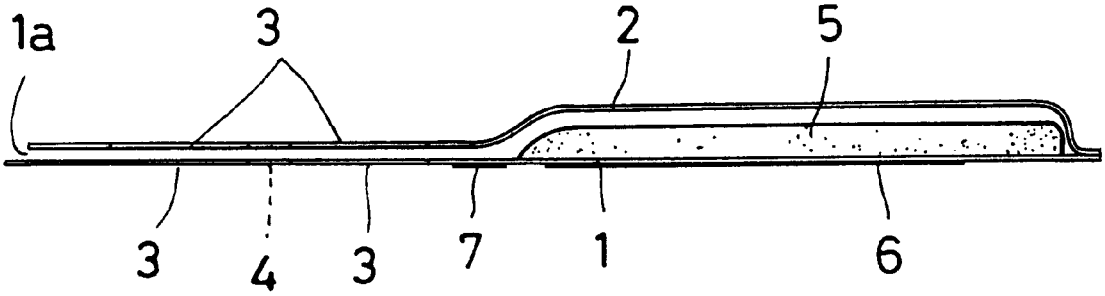
FIG. 3A is a section taken along line III—III of FIG. 1.
Figure 3B:
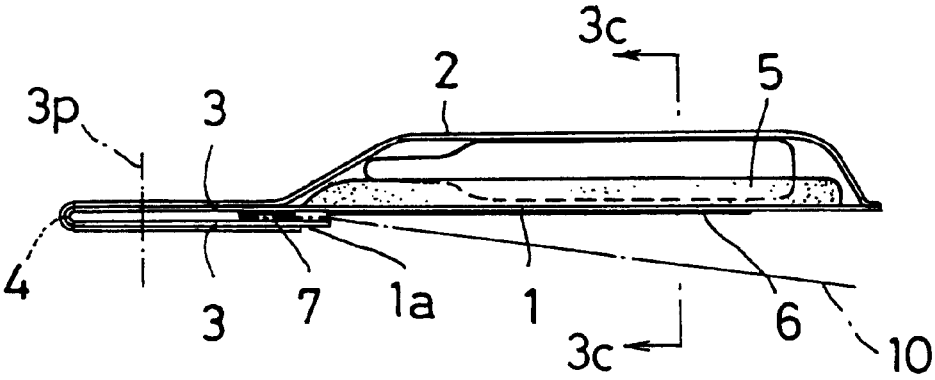
FIG. 3B is a sectional view of the bag having its tip folded.
Figure 3C:
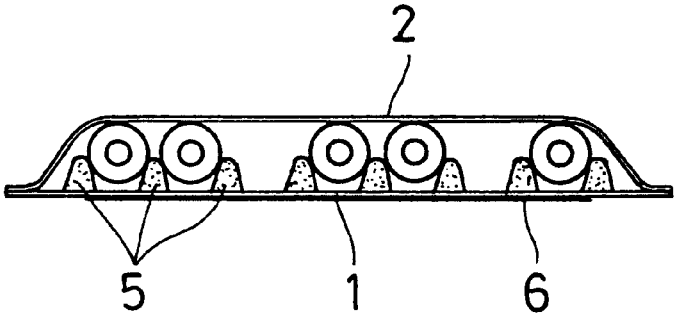
FIG. 3C is a sectional view taken along line 3C—3C of FIG. 3B.

FIG. 2 shows the bag A as seen from the other side of FIG. 1. As shown, the nontransparent sheet 1 has on its outer surface a data space 6 on which is printed data on ampules and an adhesive portion 7 covered with release paper, not shown. A prescription can be stuck on the adhesive portion 7 by peeling the release paper. FIG. 3A shows a section of the bag A. The contents of the bag are inspected through the transparent sheet 2. After inspection, the bag is folded along the fold line 4 (FIG. 3B) toward the outer surface of the nontransparent sheet 1 so that the axes 3*p* of the holes 3 will align with each other. In this state, the bag A is fitted on a bottle by inserting the bottle neck 3*a* through the holes 3, and a prescription 10 is stuck on the adhesive portion 7.

Figure 5A:
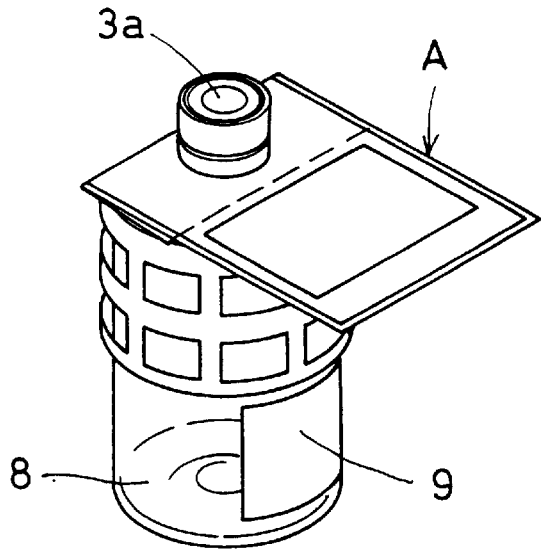
FIGS. 5A–5C are perspective views of the ampule storage bag in use.
Figure 5B:
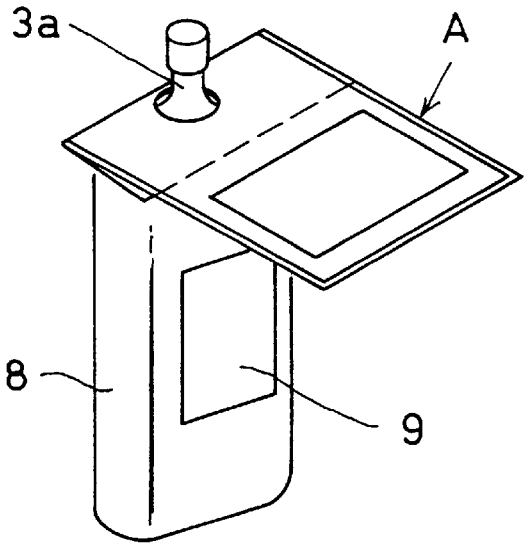
Figure 5C:
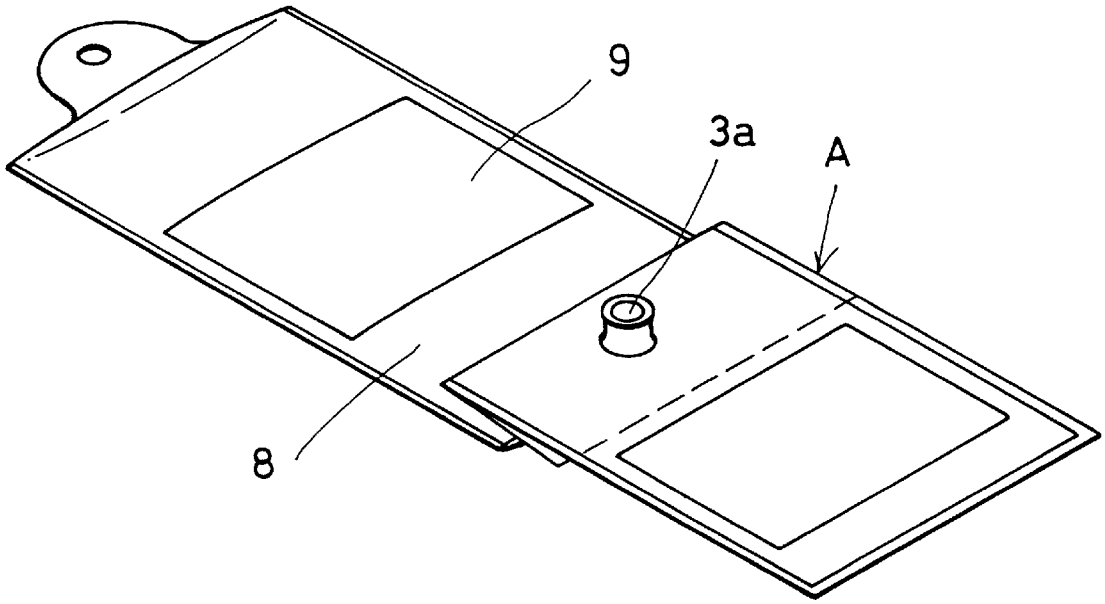

The bag A can be attached to any of the transfusion bottles 8 shown in FIGS. 5A–5C. A pharmacist checks if the patient's name shown on the label 9 of the bottle coincides with that on the data space 6 of the bag and attaches the bag to the bottle by inserting its neck 3*a* through the holes 3. The bottles shown in FIGS. 5A–5C are a glass bottle containing a fat and amino acid product, a polyethylene bottle containing e.g. a glucose product, and a polyethylene bag type bottle containing e.g. a blood product, respectively. Their necks 3*a* have diameters corresponding to the diameters of the holes 3 of the respective bags A.

Ordinarily, a transfusion bottle is sealed with a rubber plug so that the content of the bottle can be supplied into a patient's body through an injector needle stuck through the rubber plug. Injector needles can be stuck and pulled out up to three times. The content of such a bottle may be supplied directly into a patient body or after being mixed with another kind of product. The bag of the present invention is used mainly in the latter case. The bag can accommodate not only ampules as shown but also vials.

Figure 4:
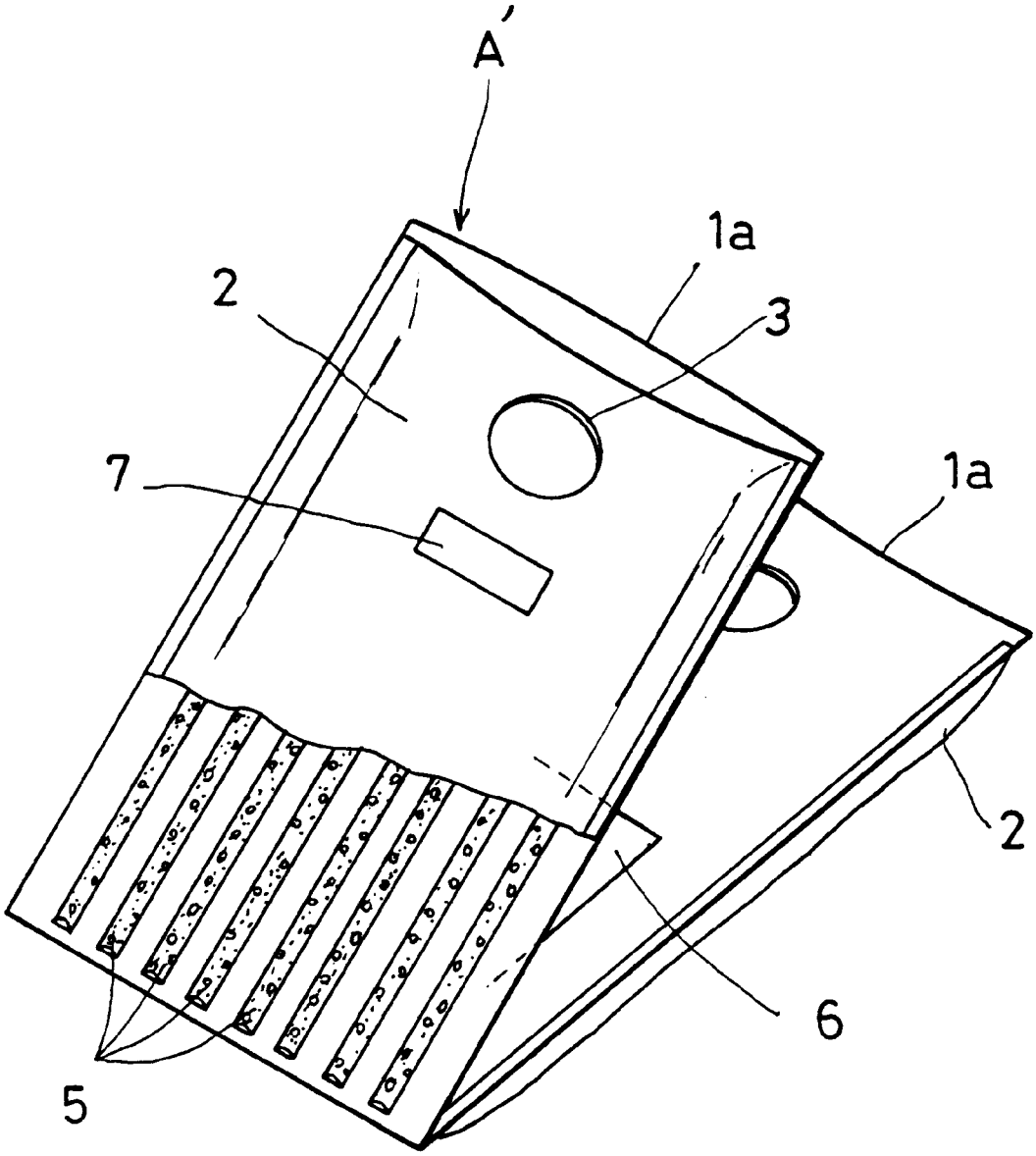
FIG. 4 is a perspective view of an ampule storage bag of another embodiment.

FIG. 4 shows an alternate embodiment of the ampule storage bag A. The bag A' of this embodiment differs from the bag A in that openings 1*a* are formed at both ends thereof and that it is folded in half along a fold line 4 extending at the longitudinal center of the bag. The bag A' is folded so that the transparent sheet 2 forms the outer layer of the bag. Holes 3 are formed near the open ends 1*a* so that they align with each other when the bag is folded in half.

Cushion members 5 are provided in each of the two compartments formed by folding the bag in half. The data space 6 is provided on the back of one compartment. The adhesive portion 7 is provided on the front side of one compartment. The bag A' can be used in exactly the same way as the bag A by folding it in half, though the following description is made solely on the bag A.

Figure 6:
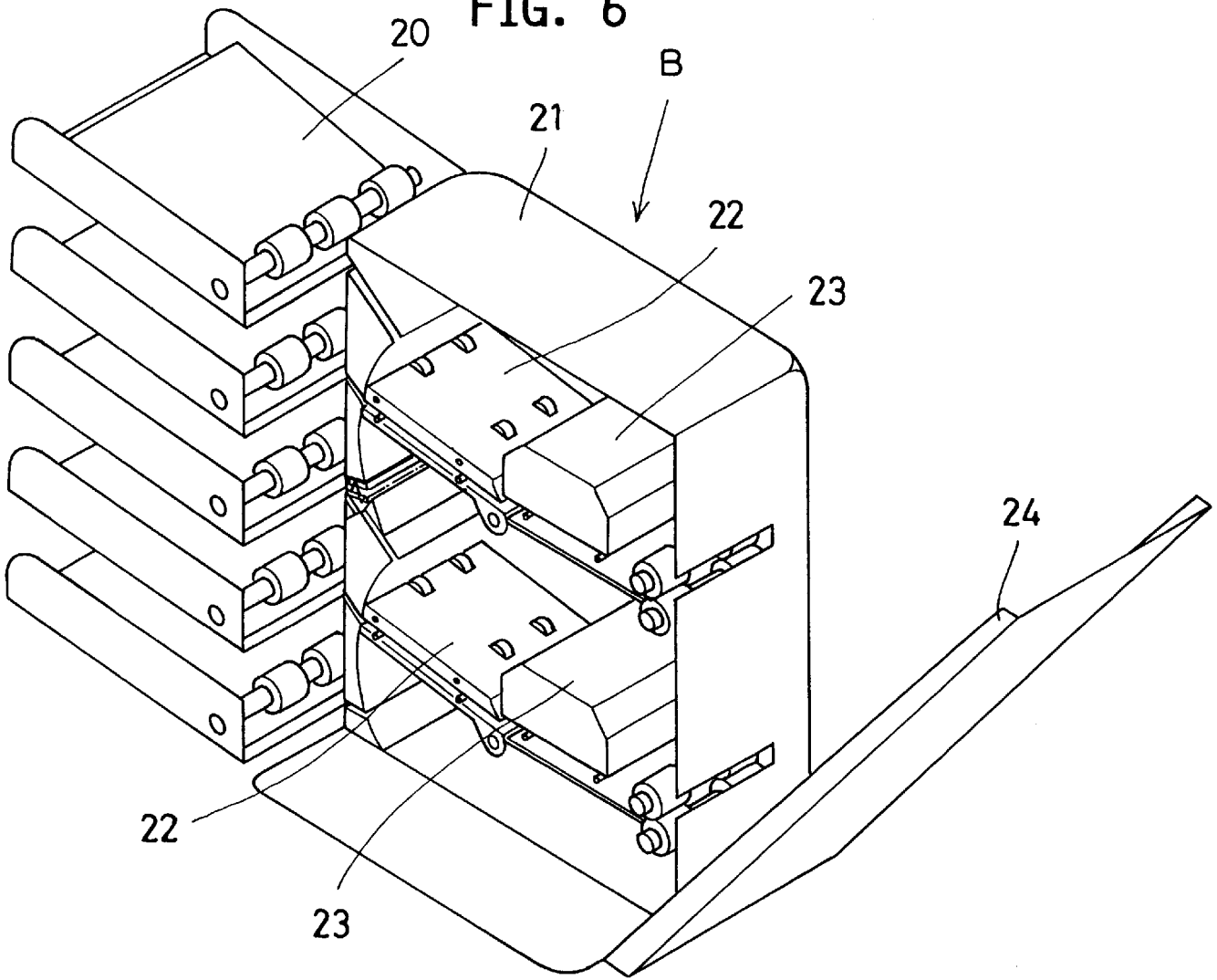
FIG. 6 is a perspective view of a printing device for the ampule storage bag.

FIG. 6 shows an automatic printing device B for printing necessary data on the data space 6 of the bag A. The printing device B comprises a feeder 20, a printer unit 21 and a chute 24. The printer unit 21 comprises, as shown, selectors 22 and printers 23. Each bag A is set in one of the top, intermediate and bottom trays of the feeder 20 according to the diameter of the neck of a bottle to which the bag is to be attached.

The feeder comprises e.g. two top trays for large-diameter bottlenecks, one intermediate tray for intermediate-diameter ones, and two bottom trays for small-diameter ones. The intermediate tray can also be used for large-diameter and small-diameter bottlenecks. An ampule storage bag is automatically selected from a feeder corresponding to printing data to be described below, and one of the printers 23 is connected to the selected feeder through one of the selectors 22 by raising or lowering one end of the selector 22 to feed the bag A into the printer 23, where necessary data are printed on the data space 6 of the bag. The bag A is then discharged into the chute 24.

In the embodiment, data are printed on each completed bag A with the printer B. But instead, data may be printed on an unfinished bag in the following manner. For example, release paper is put on adhesive portions provided at predetermined intervals on the back of a nontransparent sheet. A transparent sheet is superposed on the nontransparent sheet, and the sheets are rolled. The ends of the sheets are pulled out and they are sealed at both edges. The sheets are cut along their boundary to form bags. Necessary data are automatically printed on a data space of the bag. Bottleneck receiving holes 3 are formed. Otherwise, holes 3 are formed before printing.

The holes 3 may not be blanked holes, but may be U-shaped cutouts, cuts, or holes in the shape of + or *. Such various holes and cutouts can be collectively referred to as "holes."

The printing device B is connected to a host computer, and receives mixed injection data on how to mix drugs into a bottle for each inpatient. These data are converted into printing data and printed on the nontransparent sheet of each bag. Mixed injection data are data in prescriptions issued by doctors, and include such data as the administration of nutrients and therapeutic drugs, treatments applied and the quantities of drugs for each patient. From these mixed injection data, printing data including the name of ampuled drugs prescribed for each patient and the number of ampules are read and transmitted to the printing device.

The computer calculates the neck diameter of a bottle containing a drug to be prescribed for each patient based on the data to be printed on each bag by the printing device, and selects a feeder 20 on which is placed an ampule storage bag having holes with the same diameter as the neck diameter of the selected bottle. The selected bag A is fed to print the above necessary printing data on the bag A.

A pharmacist collects and puts ampules into corresponding bags A according to prescriptions printed by a separate printer or a prescription printing feeder of the printer B. A packaging machine may be connected to an unillustrated ampule dispenser to feed bags on which are printed necessary data by the printing device B to the packaging machine, collect ampules, open the bags, automatically put ampules in the bags, and deliver the bags to the next station. This automatic packaging machine is described later.

The operation is now described. When a hospital pharmacy receives prescription-based orders, necessary data are printed on bags A in the manner we have already described, and the bags A and prescriptions are put in buckets. The buckets are then sent to an ampule collecting station, where ampules are collected per prescriptions and put in the corresponding bags in the buckets.

The collected ampules are collated with prescriptions and the ampules whose use period has expired are removed if any. Packaged ampules are put back into the buckets, and the buckets are sent to a bottle collecting station, where bottles are taken out of a bottle storehouse and put in the buckets. The buckets are then sent to an inspection station together with the prescriptions. At the inspection station, a pharmacist checks if the ampules specified by the printed data on the bags are actually in the bags and if there are any ampules whose use period has expired or with any other problem.

Further, the pharmacist checks the contents of the bottles, their amounts, and expiration dates, and if he finds anything wrong, the corresponding bucket is sent back to the bottle collecting station. With no problems found, the pharmacist folds the bags A in the buckets along the fold line 4, attaches them to the neck of the respective bottles, puts an inspection seal on each prescription, peels the release paper off the adhesive portions 7, sticks the prescriptions on the adhesive portions 7, and puts the bag on a carriage to send the bags to a mixed injection treating room.

Figure 7:
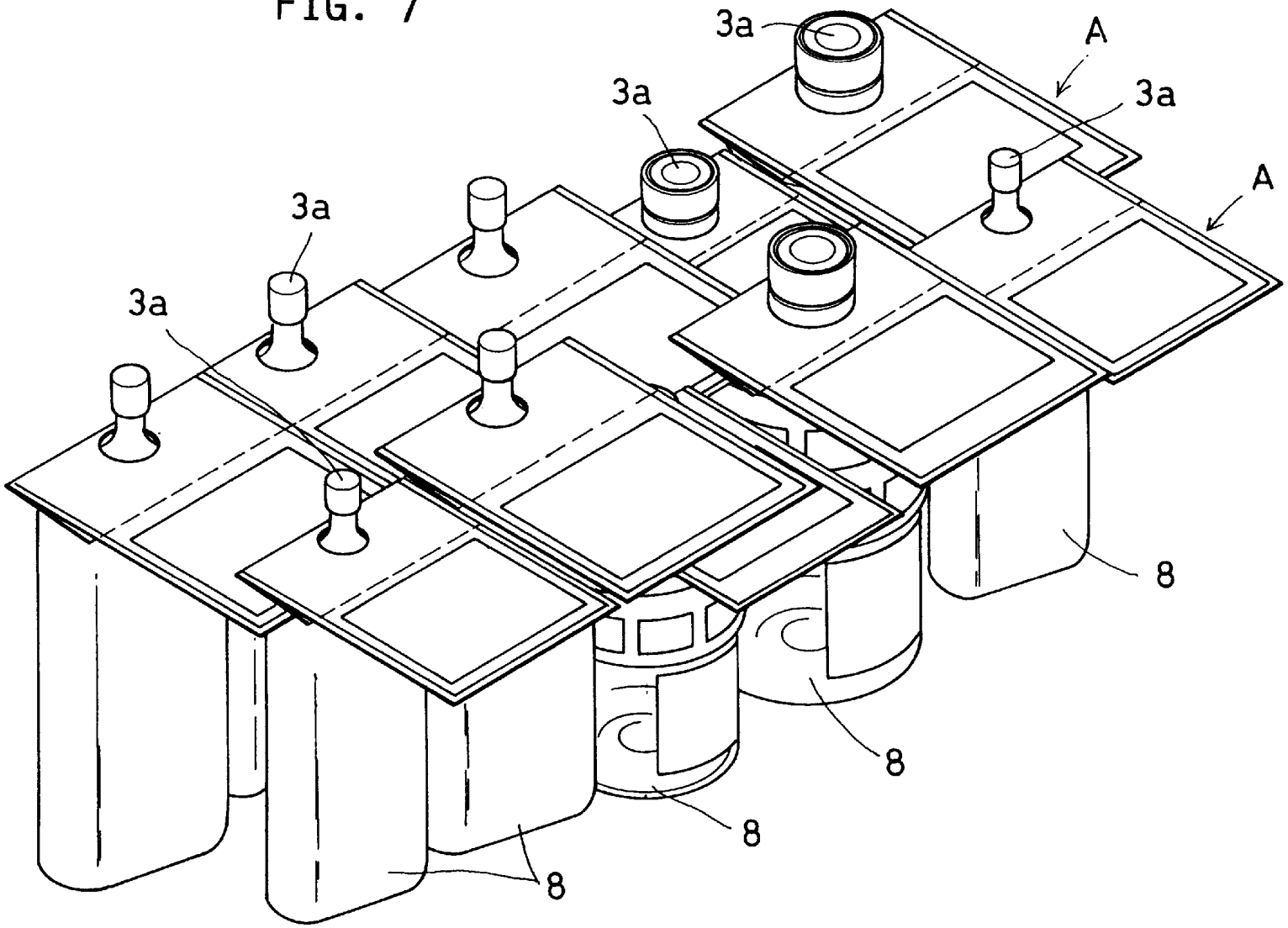
FIG. 7 is a perspective view of the ampule storage bags in use.

Bags thus collected are shown in FIG. 7, in which a plurality of bottles for a plurality of patients are shown. Since bags A are attached to the necks 3*a* of the bottles 8, the bags take up less space.

To use each drug set comprising a drug bottle and ampules (or vials) stored in a bag A attached to the neck of the bottle, a clean bench 30 is used as described below.

Figure 8:
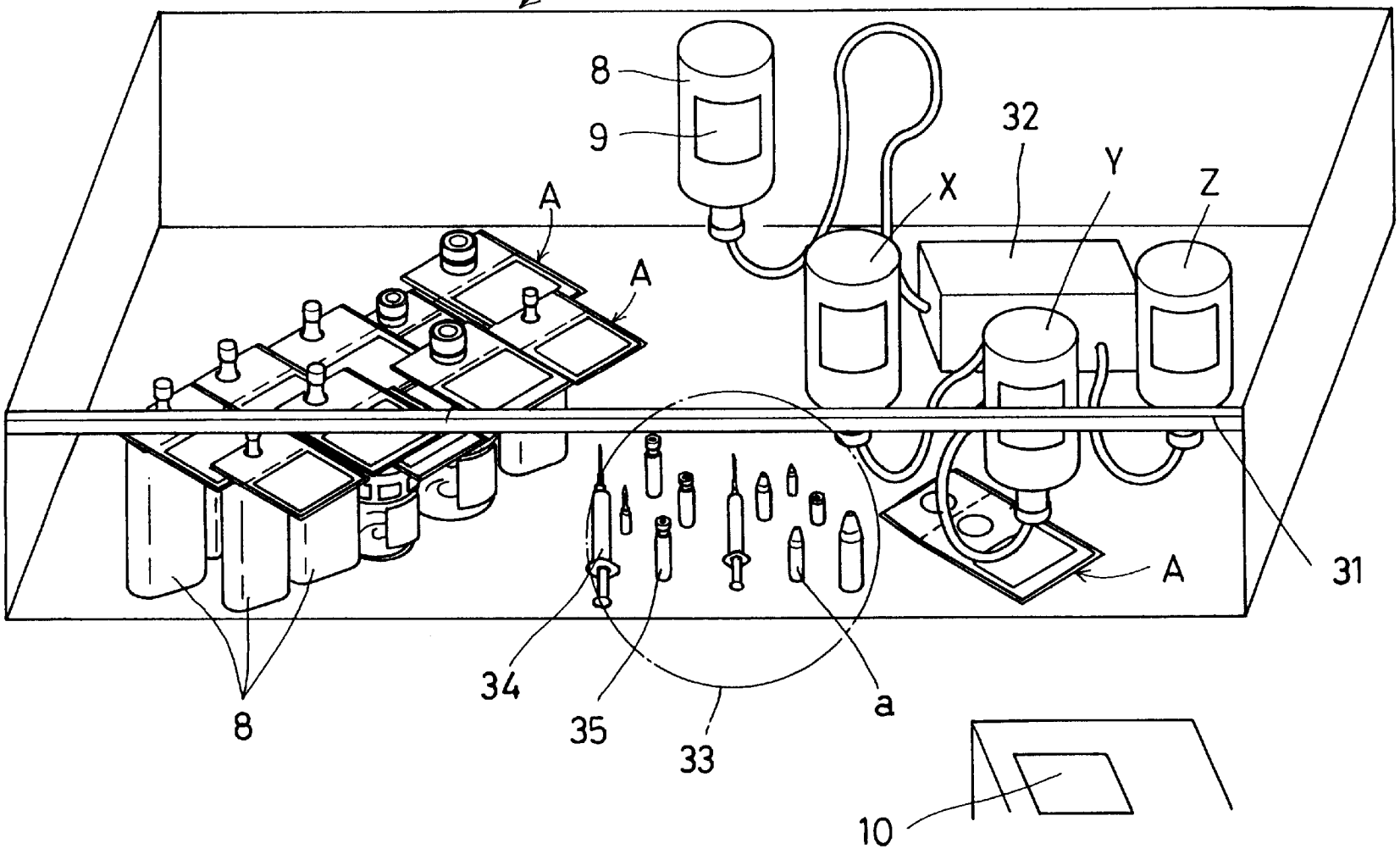
FIG. 8 is a perspective view of the ampule storage bags in use.

The clean bench 30 is installed in the mixed injection treating room. FIG. 8 shows a typical clean bench. Transfusion bottles are moved into the clean bench 30 through a front door 31 by a carriage. If the mixed injection treating room is sterilized, the clean bench 30 is not needed.

From an unillustrated fan, air is supplied through a dust-collecting, antimicrobial filter into the clean bench 30, and exhausted through the lower opening of the front door 31. The clean bench 30 has a light bulb, bottle hanger and micropump 32. To air-wash microbes that may attach to bottles while they are moving in the atmosphere, the bottles are moved into the clean bench 30 through the lower opening of the front door 31 and left in the clean bench for a while.

Injection drugs are mixed in the following manner. First, the bottle for each patient is selected. The prescription 10 stuck on the adhesive portion 7 is peeled off and placed on the workbench. Drugs are mixed together according to the mixing directions placed thereon in the following manner. The bag A is removed from the neck 3*a* of the bottle 8, and the bottle is hung from the unillustrated bottle hanger of the clean bench 30. The ampules in the bag A are then taken out of the bottle 8, and collated with the prescription to check if the ampules are the right ones.

If the prescription includes directions on adjustment of the content of the bottle, this is done by mixing mainly saccharides and optionally fat, amino acids and calorie water stored in bottles X, Y and Z by controlling the micropump 32. Ph adjustment may be made to maintain the stability of drugs. For content adjustment, one of the bottles X, Y and Z is selected, and an injector needle is connected to the bottle 8 with air in the tube exhausted.

After the content adjustment, drugs are mixed together using the drug set 33 by opening the ampules a, sucking drugs in the ampules into an injector 34, mixing the drugs into the bottle 8 by sticking the needle of the injector 34 through the rubber cap of the bottle. If the drugs contain any unstable element, the drug mixture in the injector 34 is mixed into a stabilizer contained in the bottles X, Y and Z and fed by the micropump 32.

Some drugs are in a powder form. In this case, a solution in ampules which are combined with vials is sucked into the injector 34 and mixed into the vial 35 to dissolve the powder in the vial into the solution. The mixture is sucked into the injector 34 again, and mixed with a drug in the bottle 8. When drugs are mixed together, the now empty ampules or vials of the drug set 33 or drugs remaining in ampules or vials are put in the bag A and discarded. This prevents someone from getting hurt by sharp edges of ampules.

An automatic packaging device is now described with reference to FIG. 9. The illustrated automatic packaging device 50 has an elevator 40 and a feed path R provided to the left of the elevator 40. An unillustrated dispenser puts ampules into trays 42 being fed on the path R. With ampules received, each tray 42 is moved onto a stage 41 of the elevator 40. With a tray 42 on the stage 41, the stage 41 rises while inclining to feed the ampules in the tray 42 into the automatic packaging device 50.

As shown, the automatic packaging device 50 comprises a bag-making printer unit 51, a delivery unit 52, a packaging bed 53 and a dumping bed 55. The bag-making printer unit 51 forms drug bags 63 by feeding from a roll 60 a heat-sealable sheet 61 comprising a substrate and a transparent laminate layer bonded to the substrate along both side edges and heat-sealing and cutting the sheet 61 in the width direction with a bag-making device 62. The printer unit 51 further includes a printer 64 for printing necessary information on the outer surface of the substrate of each bag 63.

The delivery unit 52 pivots a bag-landing frame at the tip of an arm pivotable about an unillustrated shaft between a substantially horizontal position and an inclined position. A bag 63 is delivered from the bag-making printer unit 51 when the bag-landing frame is horizontal, and discharged into the packaging bed 53 when it is inclined.

The packaging bed 53 and the dumping bed 55 pivot in operative association with each other, and move between the state in which the packaging bed 53 is inclined and the dumping bed 55 is substantially horizontal and the state in which the packaging bed 53 is substantially horizontal and the dumping bed 55 is vertical. The packaging bed 53 receives a bag 63 from the delivery unit 52 when the former is inclined.

A bag 63 on the packaging bed 53 is opened and ampules are put therein. The bag is then moved onto the now horizontal dumping bed 55, fed downwardly by a conveyor along the bed 55 when the bed 55 pivots to the vertical position, and put into a bag-receiving portion 105 of a bucket 104.

The bucket 104 is moved by a belt conveyor (not shown) provided under the dumping bed 55. An empty bucket 104 is deposited on the conveyor from a stock device 107. In order to put bags 63 containing ampules into the bag-receiving portions 105 of each bucket 104, each bucket 104 is fed at predetermined pitches so that each bag-receiving portion 105 is positioned right under a bag 63 supported on the vertical dumping bed 55. When bags are put in all the bag-receiving portions, the bucket is delivered to the stock device 107.

Figure 9:
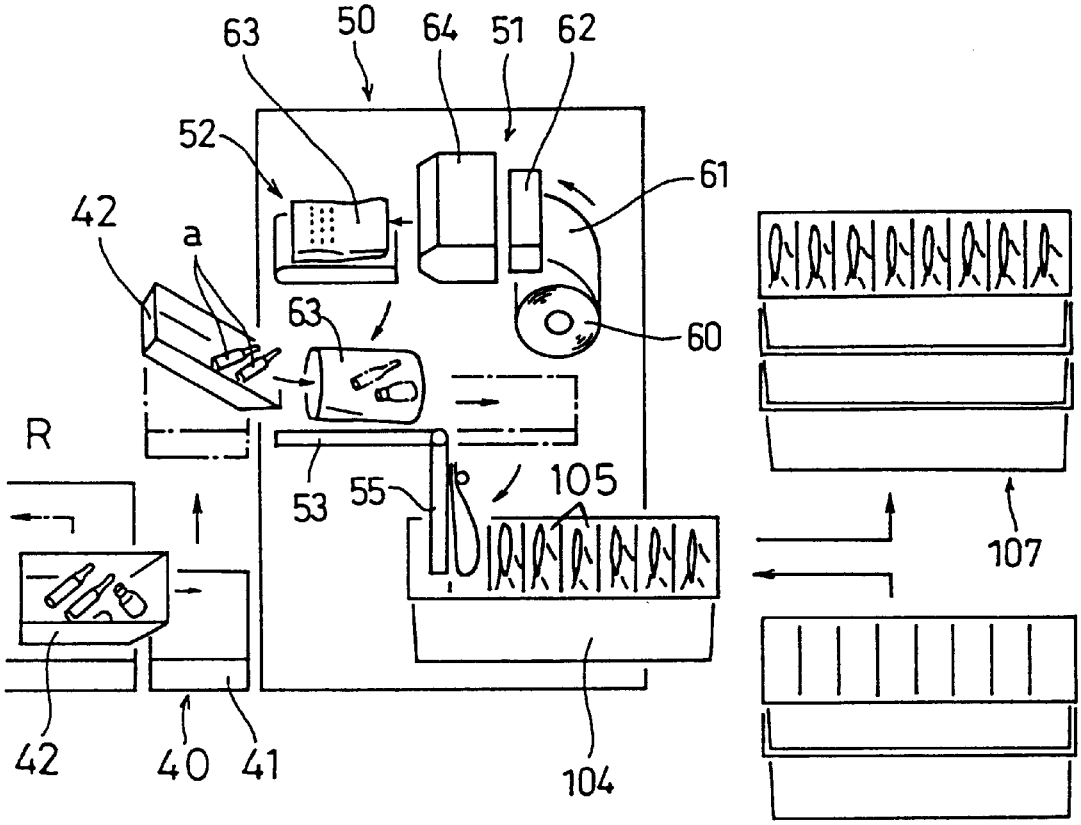
FIG. 9 is a schematic view of an automatic packaging device.

As shown in FIG. 9, the stock device 107 stocks a plurality of empty buckets 104 vertically, supplies them to the packaging device, and receives buckets 104 filled with ampules. The automatic packaging device packages ampules for each dose (for one-time use) in each bag 63.

The automatic packaging device 50 has no means for drilling bottleneck-engaging holes in the drug bags. Such a means is provided in front or back of the printer unit 51. Otherwise, such holes may be formed in completed bags. Also, the automatic packaging device 50 can automatically form holes based on data on a bottle to which the bag is to be attached when ampules are automatically put into each bag after necessary data for each patient have been received from the host computer.

As described above, the ampule storage bag according to this invention comprises a nontransparent sheet and a transparent sheet bonded thereto to define an opening. Near the opening, bottleneck-engaging holes cutouts are formed. Ampules prescribed for each patient are put in the bag. Pharmacists can see and check the ampules in the bag through the transparent sheet. The bag is attached to a transfusion bottle by inserting its neck into the bottleneck-engaging holes or cutouts. Pharmacists can easily check whether or not the ampules in the bag and the bottle to which the bag is attached are for the same patient. Thus, the drugs in the ampules and the bottle for each patient can be easily and efficiently mixed together. No large space is needed for this purpose.

What is claimed is:

1. A combination of an ampule storage bag and a transfusion bottle, wherein:

said ampule storage bag has four sides and comprises a non-transparent sheet and a transparent sheet bonded to said non-transparent sheet along three of said four sides so as to form an opening along a remaining one of said four sides, said ampule storage bag being formed with two holes extending through each of said non-transparent and transparent sheets near said opening; and said transfusion bottle includes a neck portion which is removably insertable through said holes when said holes are aligned with each other.

2. A combination as claimed in claim 7 wherein said ampule storage bag includes a fold line provided near said opening, and wherein, for each of said transparent and nontransparent sheets, said two holes are provided symmetrically with respect to said fold line.

3. A combination as claimed in claim 1 wherein an adhesive portion on which a prescription sheet can be stuck is provided on one side of said ampule storage bag.

4. A combination as claimed in claim 1 wherein said nontransparent sheet has a data printing space on which are printed data including the name of a patient, the contents and number of ampules put in said bag, and the content of said transfusion bottle.

5. A combination as claimed in claim 1 further comprising cushion members provided in said ampule storage bag.

* * * * *